United States Patent [19]

Best

[11] 4,205,839

[45] Jun. 3, 1980

[54] EXERCISING DEVICE HAVING HAND GRIPS AND FOOT STIRRUPS ATTACHED TO LINES

[76] Inventor: Melvin H. M. Best, 131 Marine Ave., Wilmington, Calif. 90744

[21] Appl. No.: 827,878

[22] Filed: Aug. 26, 1977

[51] Int. Cl.[2] ..... A63B 21/00

[52] U.S. Cl. ..... 272/126; 220/94 R; D8/DIG. 1; 224/50; 272/67; 272/900

[58] Field of Search ..... 272/126, 116, 900, 143, 272/144, 133, 67; 128/25 R; 224/50; 220/94; D8/DIG. 1

[56] References Cited

U.S. PATENT DOCUMENTS

| | | | |
|---|---|---|---|
| 3,752,474 | 8/1973 | Macabet et al. | 272/126 |
| 3,979,114 | 9/1976 | Codina | 272/126 |
| 3,999,752 | 12/1976 | Kupperman et al. | 272/143 X |
| 4,060,240 | 11/1977 | Dunston | 272/126 |

*Primary Examiner*—William R. Browne
*Attorney, Agent, or Firm*—Albert M. Herzig; Edward C. Walsh

[57] ABSTRACT

An improved exercising device of the type shown in U.S. Pat. No. 3,858,874. A pair of lines or cords pass over sheaves in pulley blocks carried on a rigid member attachable to a fixed support. The rigid member is sufficiently elongated to hold the sheaves or grooved pulleys in operative position when there is tension on only one or the other of the lines. Hand grips are provided with adjustable fittings at the ends of the lines so that the hand grips can be held in a desired position relative to the line extending from the grip. Foot stirrups are provided for each foot in the form of a cradle with openings for the front part of the foot in the form of a cradle with openings for the front part of the foot, the heel, and the ankle bones.

1 Claim, 10 Drawing Figures

EXERCISING DEVICE HAVING HAND GRIPS AND FOOT STIRRUPS ATTACHED TO LINES

BACKGROUND OF THE INVENTION

1. Field of the Invention

The field of the invention is that of exercising devices of the type calculated to provide readily usable means whereby individuals can perform physical exercises in a convenient and pleasant way and without having available the facilities ordinarily available in a gymnasium or otherwise.

2. Description of the Prior Art

The herein invention is an improvement in the exercising device disclosed in U.S. Pat. No. 3,858,874. other prior art patents include the following: 1,144,085, 2,716,027, Swiss Pat. No. 48.984 and British Pat. No. 334,255. The exercising device of U.S. Pat. No. 3,858,874 is a highly successful device and has been widely commercialized in the United States and in foreign countries. The herein invention provides specific improvements in the device as specifically detailed and outlined hereinafter.

SUMMARY OF THE INVENTION

In the exemplary form of the invention it is basically similar to the exercising device of U.S. Pat. No. 3,858,874 which is hereby incorporated herein by reference.

As in the previous patent the exercising device provides a pair of flexible lines which pass over sheaves or pulleys carried in pulley blocks. The member carrying the sheaves or pulley blocks is secured to a fixed support. At one end of each of the lines there is a hand grip of particular construction as will be described. At the other end of each line is a foot stirrup or cradle for the foot, these stirrups being of particular construction as will be described.

The pulley blocks carrying the pulleys or sheaves are mounted on a rigid bar which is of T shape having a cross member which carries the pulley blocks. This construction enables the pulleys or sheaves to operate freely when there is tension on only one of the lines rather than on both of them and in any position that the user may take.

Each hand grip includes a grip part and a loop or guard part to which the line is attached by way of an adjustable fitting. This enables the user to hold the hand grip in a convenient or desired position with respect to the direction that the line, when in tension, may have relative to the grip.

Each foot stirrup is in the form of a padded cradle constructed to receive the foot with the front part of the foot extending from the cradle and with an opening to receive the heel and openings for the ankle bones. The cradle is constructed preferably of layers of plastic or fabric material with sheet foam between the layers. Thus, the stirrup provides an extremely comfortable but effective cradle for the foot in any position of use of the exercising device.

In the light of the foregoing the primary object is to provide an improved and more effective, more comfortable exercising device of the type referred to in the foregoing and of the type shown in U.S. Pat. No. 3,858,874.

A further object is to improve the exercising device of the type referred to by way of mounting the pulleys on a rigid bar to insure free operation of the pulleys without binding when there is tension either on one or both of the lines and in any position that the user may have his or her arms and/or legs.

Another object is to realize increased comfort and usability of the means for grasping the lines by way of hand grips having adjustability as to the position of attachment of the line to the grip.

Another object is to realize greater comfort and usability as to the holding of the lines by the feet by means of stirrups in the form of cradles which are cushioned with padding and are constructed to engage an area of the instep of the foot and an area in the back of the foot for maximum comfort.

Further objects and additional advantages of the invention will become apparent from the following detailed description and annexed drawings.

DESCRIPTION OF THE PREFERRED EMBODIMENT

Figure 1:
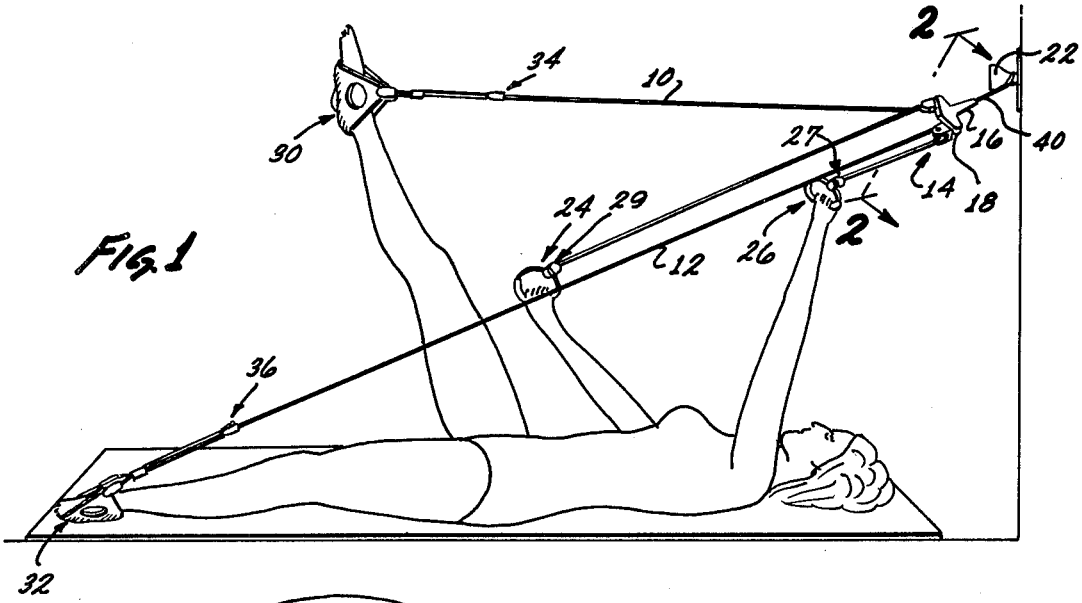
FIG. 1 is a view of the exerciser illustrating its usage.
Figure 2:
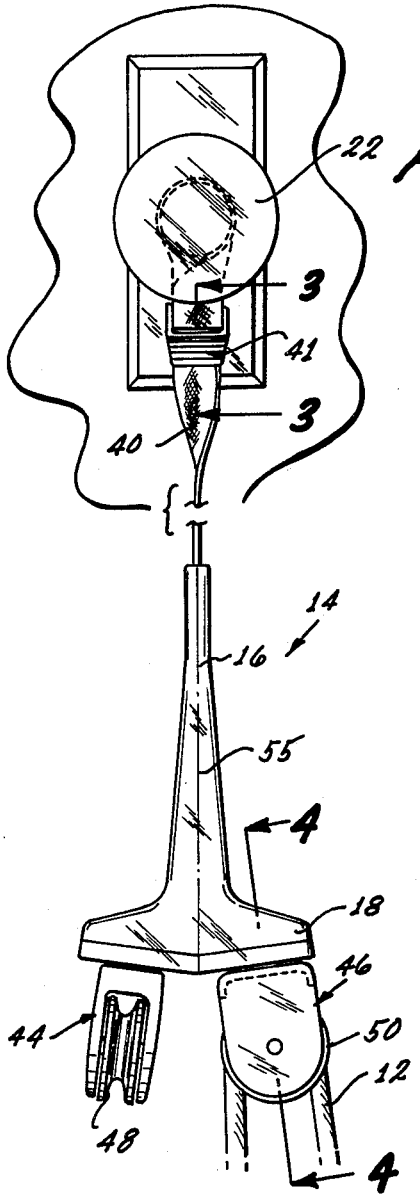
FIG. 2 is an enlarged view of the rigid bar mounting the sheaves and the attachment to a door knob.

FIG. 1 illustrates a preferred exemplary embodiment of the invention. The product includes lines or cords as designated at 10 and 12 which are preferably of synthetic fiber, that is, plastic materials which may be nylon, dacron, polyester material or polypropylene or polyethylene. Numeral 14 designates a rigid bar which preferably is in the form of a T-bar having a shank part 16 and a cross member 18 as may be seen in FIG. 2 on which the sheaves or pulleys are mounted as will be described. The rigid bar 14 is attachable to or may be secured to a doorknob as shown at 22 in FIG. 1.

At the ends of the lines 10 and 12 are hand grips as designated at 24 and 26 and as will be described more in detail presently. The hand grip 26 is shown more in detail in FIG. 5. Cord 12 is attached to it by way of fitting 27 shown in detail in FIG. 6 and cord 10 is similarly attached to grip 24 by a similar fitting 29.

Figure 7:
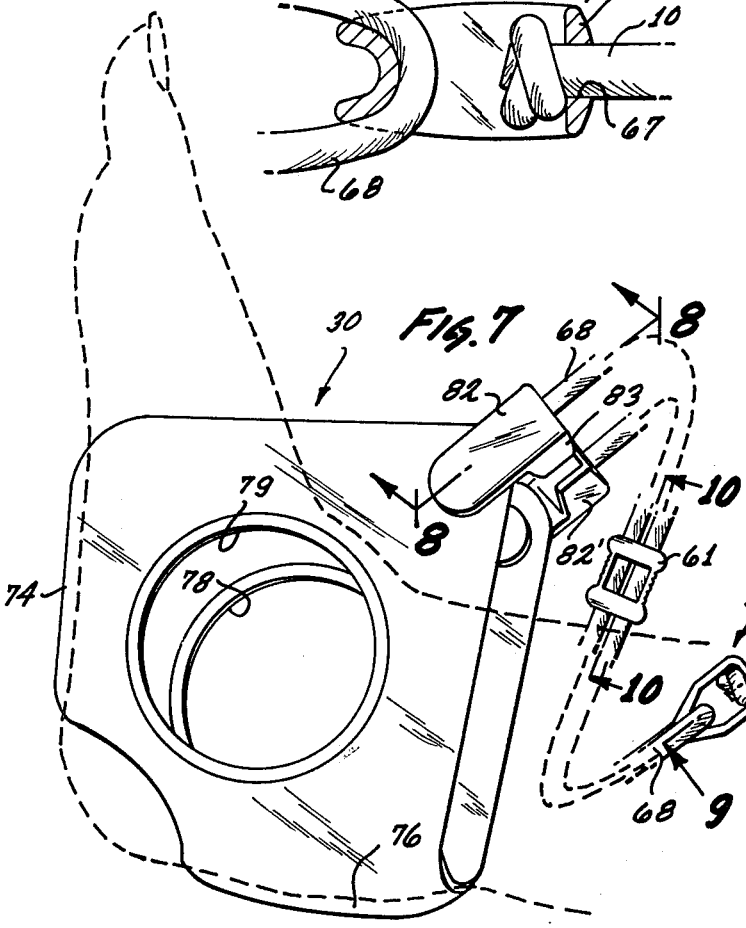
FIG. 7 is a pictorial view of the foot stirrup or cradle.

At the opposite ends of lines 10 and 12 are foot stirrups or cradles as designated at 30 and 32, with stirrup 30 being shown more in detail in FIG. 7. Near the end of the line 10 is a fitting 34 from which attachment is made to the stirrup 30 and numeral 36 designates a similar fitting associated with the stirrup 32. The fitting 34 is shown in detail in FIGS. 7 and 9.

THE T-BAR

Figure 3:
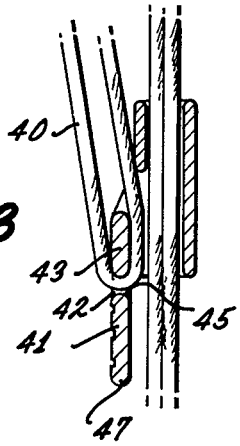
FIG. 3 is a sectional view taken along the line 3—3 of FIG. 2.

The rigid T-bar 14 may be in the form of a casting made of a suitable metal. Secured to the shank 16 of the T-bar is a web strap 40 which can be looped over the doorknob as shown. On the strap is a metal slider 41, one end of the strap being secured to the slider as shown at 42, by being looped over extending lug 43, a part of the strap passing through opening 45 bertween lug 43 and lug 47. See FIG. 3. The T-bar 14 may be made of two symmetrical halves joined along line 49 with strap 40 clamped between the halves.

Figure 4:
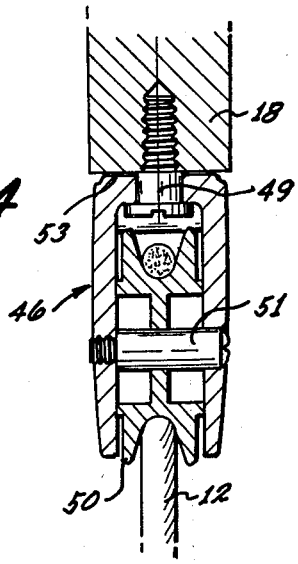
FIG. 4 is a sectional view taken along the line 4—4 of FIG. 2.

Mounted on the cross member 18 are two sheaves or pulley blocks 44 and 46, the block 46 being shown more in detail in FIG. 4. Preferably the pulley blocks are attached to faces of the T-bar that are at an angle as shown. These blocks carry grooved pulleys 48 and 50 on shoulder bolts as shown at 51 in FIG. 4. As shown in FIG. 4 the pulley block 46 has swiveling attachment to the cross bar 18, being pivotally mounted on the screw shank 49 extending from the cross bar 18 with an anti-friction disc member 53 in between the surfaces.

The shank 16 is relatively long relative to the cross bar 18 so that when tension is on one sheave only it still operates freely without binding. The sheave pulleys have open separated flanges as shown, the flanges being at an angle to one another. The faces of cross bar 18 are at an angle as stated and this allows the lines to pass over the sheaves at angles which accommodate for the width of the user's shoulders with the lines coming to the pulleys normally at angles depending upon the width of the user's shoulders. If desired the sheave blocks can be mounted to be canted outwardly at a slight angle to further enhance the adaptability of the lines moving over the pulleys at an angle.

THE HAND GRIPS

Figure 5:
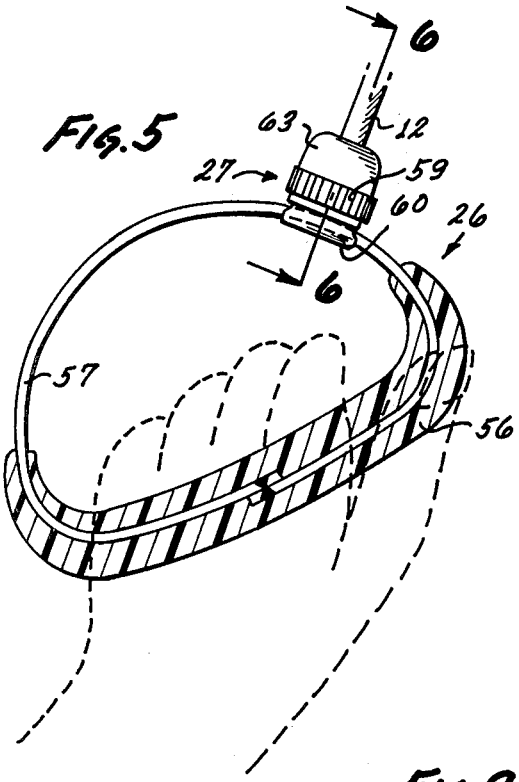
FIG. 5 is a detail isometric view of one of the hand grips.
Figure 6:
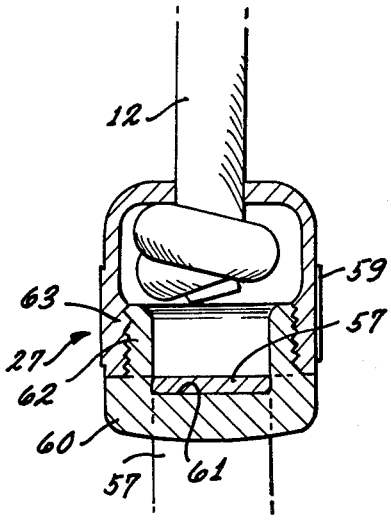
FIG. 6 is a detail sectional view of one of the connector fittings used at ends of the lines.

The hand grip 26 is shown in detail in FIG. 5. It has a curved handle or grip part 56 which may be of D-shape as shown preferably formed of self-skinning molded or foamed plastic to provide a comfortable hand grip. The hand grip is molded onto the metal portion 57 which may be of an oval shape as shown and mounted on the part 57 is a slider 60 having an opening in it as designated at 61 in FIG. 6 so that this slider can slide on the part 57 of the hand grip. The slider 60 constitutes the male part of a male-female coupling device 27. Slider 60 includes threaded boss 62. Numeral 63 designates an internally threaded socket with knurled part 59 which threads over the slider 60 and can engage the part 57 so as to set the slider in any position on the part 57 of the grip. Cord 12 passes through a hole in socket 63 with a knot at its end.

As may be seen from FIG. 5 the hand grip may be adjustably set relative to the part 57 in a variety of positions. This enables the user to establish a desired relationship between the hand grip and the angle of the line leading to the grip. Two positions are illustrated in FIG. 1. Thus, the angle can vary from having the hand and arm at 90 degrees to the line to a position wherein the line extends directly from the midpoint of the grip in line with the arm. This makes it possible for the user to have his or her hand and arm in different positions relative to the tension in the line so that different muscles can be exercised and developed.

LINE ATTACHMENT FITTINGS

Figure 9:
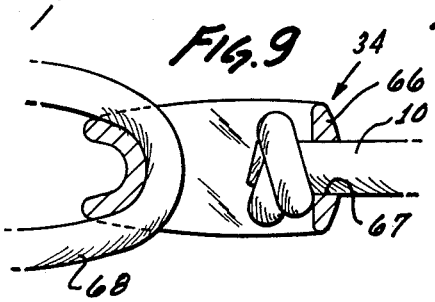
FIGS. 8, 9 and 10 are cross-sectional views taken along lines 8—8, 9—9, and 10—10 of FIGS. 8, 9, and 10 respectively.
Figure 10:
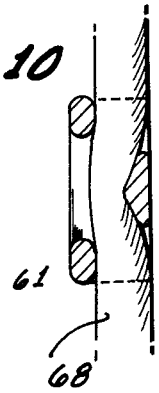

One of the fittings 34 for attachment of the line 10 to the foot stirrups is illustrated in FIGS. 7 and 9. It includes a loop part 66 which has a hole 67 through which cord 10 passes with a knot on its end. Cord 68 passes through loop member or fitting 34 and its ends are attached to foot cradle 30 as will be described.

FOOT STIRRUPS

One of the foot stirrups 30 is shown in detail in FIG. 7. At the end of the line 10 as shown in FIG. 7 is the metal fitting 34 having cord 68 passing through the part 61. This cord attaches to the stirrup as will be described. The stirrup has a shape as shown in FIG. 7 forming a cradle for the foot. the front part of the foot extends from the cradle as shown, the cradle having a portion 74 accommodating the instep of the foot and a portion 76 at the back of the foot. Preferably the stirrup is fabricated from a plastic or fabric material into the shape as shown with the material stitched or sown together around the edges or secured by adhesive bonding. Between the layers of the plastic or fabric there is provided padding or cushioning material which may be foam plastic or other comparable material. Alternatively, the stirrup may be fabricated from sheet foam molded into the shape as shown. At opposite sides of the stirrup there are round openings, as shown at 78 and 79 to accommodate the user's ankle bones.

Figure 8:
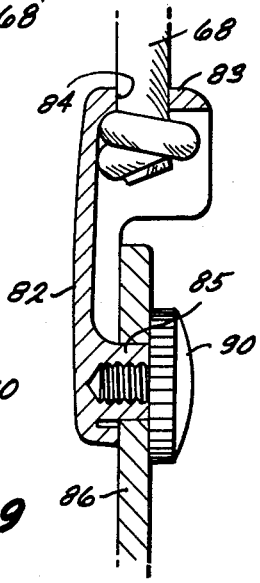

The line 68 is attached to the top corners of the stirrup as illustrated in FIG. 7. Numeral 82 designates a metal fitting having a transverse part 83 with a hole 84 in it through which the cord 68 passes with a knot on its end. Numeral 86 in FIG. 8 designates the fabric or other material at one of the upper corners of the stirrup. Fitting 82 has an internally threaded boss 85 and material 86 has an opening fitting over the boss as shown. Numeral 90 designates a knurled screw which threads into the boss 85. A second fitting 82' is provided on the other side of the stirrup, the two fittings constituting lefts and rights, otherwise being exactly alike.

From the foregoing those skilled in the art will readily understand and appreciate the nature of the improvements and the manner in which they contribute to the realization of the objects as set forth in the foregoing. The mounting of the sheaves assures freedom of operation of the lines without binding in whatever positions the user may take or whatever manipulations are undertaken. Any possible fouling or binding of the lines at the pulleys is avoided. The invention provides a very high quality article enabling the user to resort to a variety of exercising techniques capable of exercising different sets of muscles. The maximum of comfort and usability are present when utilizating any of the available techniques or types of movements of the arms and legs and positions of the torso.

The hand grips make it possible for the user to grasp them in positions with the tensioned line leading from the hand grip at various angles with respect to the hand and arm of the user. This makes it possible for the stresses resulting from the tension in the line to be applied to various different muscles of the wrist and arm depending upon the position of attachment of the line to the grip.

The design of the stirrups assures that the user's foot will remain in the stirrup or cradle during the various manipulations and movements during usage. The cradle stays firmly in position on the foot by reason of the opening to receive the heel and the openings to receive the ankle bones of the foot. By reason of the padded or cushioned construction of the stirrup, comfort is assured at all positions of use.

The foregoing disclosure is representative of a preferred form of the invention and is to be interpreted in an illustrative rather than a limiting sense the invention to be accorded the full scope of the claims appended hereto.

What is claimed is:

1. In an exercising device of the type having flexible line means for manipulation by a user, each said first and second line means having means at one end for engagement by a person's hands and means at the other ends for engagement by a person's feet, and pulley means adapted to be held by a fixed support having both lines passing over the pulley means so that each of the first and second line means can be tensioned by respective hand and foot movements, the improvements including means at one end of each line means having a hand grip having a grip part and an attachment part in the form of a guard extending from the grip part, and means including a fitting on an end part of said first and second line means, the fitting including an adjustable member having means for securing at an adjustable position on the attachment part, the member including a setting screw for setting the fitting at adjusted positions on the attachment part to provide for various angular relationships between the user's arm and the attached line.

* * * * *